US009579683B2

(12) United States Patent
Huang

(10) Patent No.: US 9,579,683 B2
(45) Date of Patent: Feb. 28, 2017

(54) SURFACE TREATMENT APPARATUS

(75) Inventor: Ting-Hui Huang, Hsinchu (TW)

(73) Assignee: Eterbright Solar Corporation, Miaoli County (TW)

( * ) Notice: Subject to any disclaimer, the term of this patent is extended or adjusted under 35 U.S.C. 154(b) by 1337 days.

(21) Appl. No.: 13/420,744

(22) Filed: Mar. 15, 2012

(65) Prior Publication Data

US 2013/0125930 A1 May 23, 2013

(30) Foreign Application Priority Data

Nov. 18, 2011 (TW) ..... 100221907 U

(51) Int. Cl.
*B08B 3/00* (2006.01)
*B05C 5/02* (2006.01)
*B05C 9/06* (2006.01)

(52) U.S. Cl.
CPC ..... *B05C 5/0208* (2013.01); *B05C 5/0283* (2013.01); *B05C 9/06* (2013.01)

(58) Field of Classification Search
CPC ..... B05C 5/0208; B05C 9/06; B05C 5/0283
See application file for complete search history.

(56) References Cited

U.S. PATENT DOCUMENTS 4,143,468 A * 3/1979 Novotny ..... B05D 3/067 250/398
6,383,303 B1 * 5/2002 Wee ..... B08B 3/022 134/131
7,134,946 B1 * 11/2006 Jackson ..... B24C 1/003 134/10
2003/0085306 A1 * 5/2003 John ..... B05B 13/0278 239/536
2008/0092925 A1 * 4/2008 Hong ..... H01L 21/6708 134/21

FOREIGN PATENT DOCUMENTS

IT EP 2103356 A2 * 9/2009 ..... B05B 13/0278
IT WO 2009147481 A1 * 12/2009 ..... B05B 13/0278

* cited by examiner

*Primary Examiner* — Michael Barr
*Assistant Examiner* — Benjamin L Osterhout
(74) *Attorney, Agent, or Firm* — WPAT, PC; Justin King; Douglas Hosack

(57) ABSTRACT

A surface treatment apparatus, disposed around a conveying device conveying a substrate in a predetermined conveying direction, includes: first and second liquid nozzles, disposed at an adjustable angle above the conveying device, each having an axial direction perpendicular to an axial direction of the conveying device, in which the second liquid nozzle is spaced apart from the first liquid nozzle by a first predetermined distance in the predetermined conveying direction, and the first and second liquid nozzles incline at a first angle facing each other; and first and second liquid level baffles, disposed on two sides of the conveying device respectively and spaced apart from the conveying device by a gap, in which the first and second liquid level baffles are located within the first predetermined distance spaced apart between the first and second liquid nozzles.

4 Claims, 4 Drawing Sheets

SURFACE TREATMENT APPARATUS

BACKGROUND OF THE INVENTION

Field of Invention

The present invention relates to the technical filed of surface treatment, and more particularly to a surface treatment apparatus for a substrate.

Related Art

Generally speaking, a chemical treatment process of a substrate starts with a dipping process, i.e., dipping the whole substrate in a chemical liquid, then drying the substrate by means of spinning via a spin dryer, and roasting the substrate to be dried out after entering into an oven.

However, a chemical thin film (for example, a $Na_2S$ thin film) is likely to be formed on the surface of the substrate when dipping the substrate in the chemical liquid, and it requires dipping for a long time; moreover, the roasting temperature in the oven shall be at least higher than 100° C., which is very undesirable based on considerations of safety.

Furthermore, for the gas nozzle (air knife) for intensively drying out the substrate used by a common liquid crystal panel factory, the exit pressure is approximately larger than 10 $kgf/cm^2$, and the excessive pressure easily causes uneven distribution of the undried liquid film.

SUMMARY OF THE INVENTION

Accordingly, the present invention is mainly directed to a surface treatment apparatus, which enables the chemical liquid to form an effect similar to wiping with a cleaning cloth on the surface of the substrate, so that the chemical treatment on the surface of the substrate will be finished in a very short time by means of wiping, so as to chemically treat a local area of the substrate.

The present invention is also directed to a surface treatment apparatus, in which the temperature of the hot dry gas may be controlled below 90° C. based on considerations of safety and drying effects.

In order to achieve the above objectives, the present invention provides a surface treatment apparatus, disposed around a conveying device of a substrate, wherein the substrate is placed on the conveying device and conveyed in a predetermined conveying direction, and the predetermined conveying direction is parallel to an axial direction of the conveying device. The surface treatment apparatus comprises: a first liquid nozzle, disposed at an adjustable angle above the conveying device, wherein an axial direction of the first liquid nozzle is perpendicular to the axial direction of the conveying device; a second liquid nozzle, disposed at an adjustable angle above the conveying device, and spaced apart from the first liquid nozzle by a first predetermined distance in the predetermined conveying direction, wherein an axial direction of the second liquid nozzle is perpendicular to the axial direction of the conveying device, and the first liquid nozzle and the second liquid nozzle incline at a first angle facing each other; a first liquid level baffle, disposed on one of sides of the conveying device, spaced apart from the conveying device by a gap, and located within the first predetermined distance spaced apart between the first liquid nozzle and the second liquid nozzle; and a second liquid level baffle, disposed on one side of the conveying device away from the first liquid level baffle, spaced apart from the conveying device by the gap, and located within the first predetermined distance spaced apart between the first liquid nozzle and the second liquid nozzle.

The first liquid nozzle and the second liquid nozzle are used to spray a chemical liquid, and the first liquid nozzle and the second liquid nozzle are blade-shaped.

The surface treatment apparatus further comprises a third liquid nozzle, disposed below the conveying device, wherein the third liquid nozzle and the second liquid nozzle are spaced apart by a second predetermined distance in the predetermined conveying direction, the third liquid nozzle inclines at a second angle facing the conveying device in a direction opposite to the predetermined conveying direction, and the third liquid nozzle is used to spray a cleaning liquid.

The surface treatment apparatus further comprises a first gas nozzle and a second gas nozzle, wherein the first gas nozzle is disposed above the conveying device and spaced apart from the third liquid nozzle by a third predetermined distance in the predetermined conveying direction, the second gas nozzle is disposed below the conveying device and corresponding to the first gas nozzle, and the first gas nozzle and the second gas nozzle incline at a third angle facing the conveying device in the direction opposite to the predetermined conveying direction.

The surface treatment apparatus further comprises at least one third gas nozzle and at least one fourth gas nozzle, wherein the third gas nozzle is spaced apart from the first gas nozzle by a fourth predetermined distance and disposed above the conveying device, the fourth gas nozzle is spaced apart from the second gas nozzle by the fourth predetermined distance and disposed below the conveying device and corresponding to the third gas nozzle, and the third gas nozzle and the fourth gas nozzle incline at a fourth angle facing the conveying device in the direction opposite to the predetermined conveying direction.

The at least one third gas nozzle is a plurality of third gas nozzles spaced apart from one another in the predetermined conveying direction, the at least one fourth gas nozzle is a plurality of fourth gas nozzles spaced apart from one another in the predetermined conveying direction, and the amount of the third gas nozzles corresponds to the amount of the fourth gas nozzles.

In order to make the aforementioned objectives and advantages of the present invention more comprehensible, embodiments accompanied with figures are described in detail below.

Definitely, the present invention may take different physical form in certain parts or arrangement of parts. However, a preferred embodiment of the present invention, which will be described in detail in the following specification, is illustrated in the accompanying drawings.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
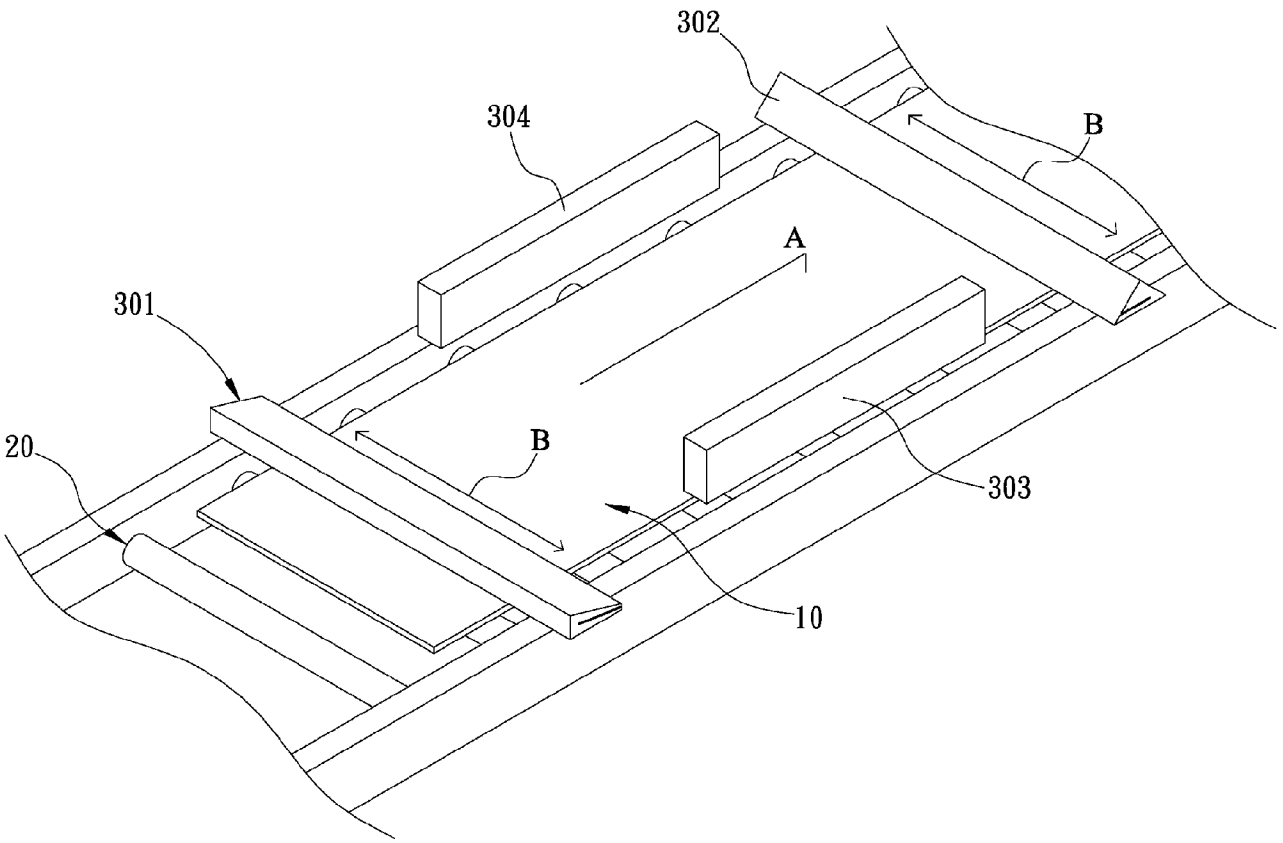
FIG. 1 is a schematic structural view of a surface treatment apparatus of the present invention.
Figure 2:
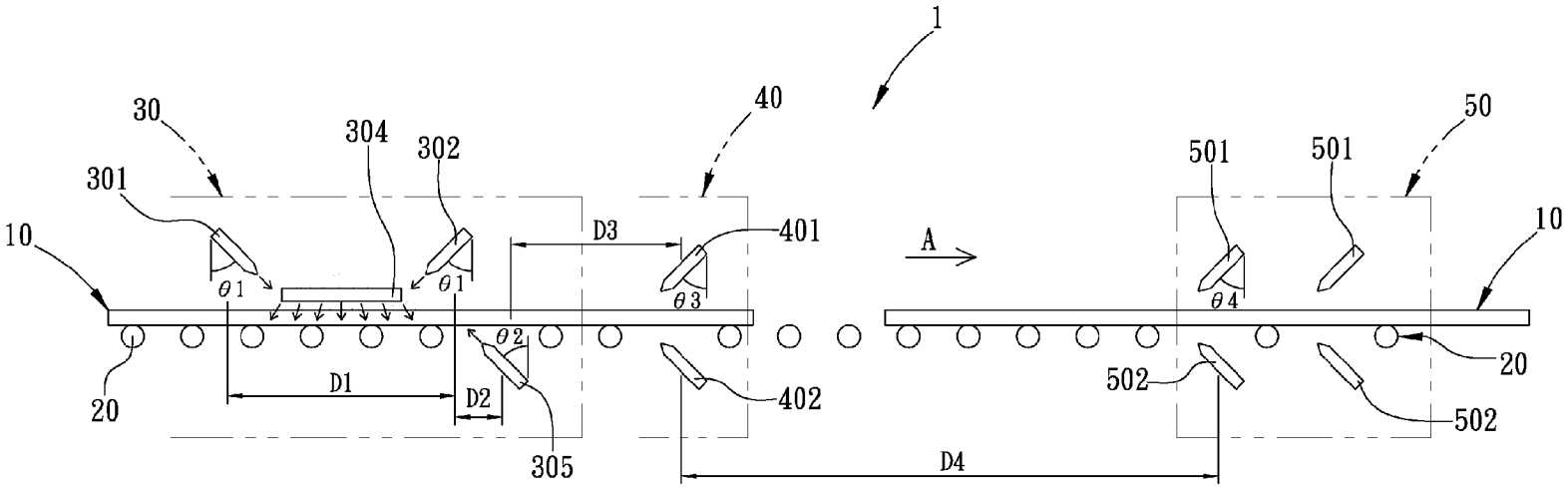
FIG. 2 is a schematic view illustrating operation of a surface treatment apparatus of the present invention.
Figure 3:
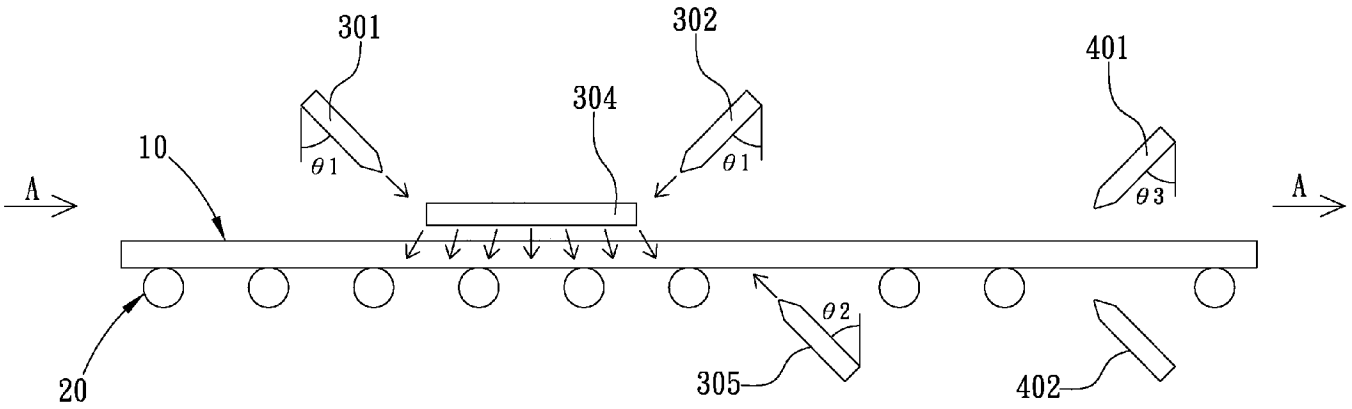
FIG. 3 is a schematic side view of a surface treatment apparatus of the present invention.
Figure 4:
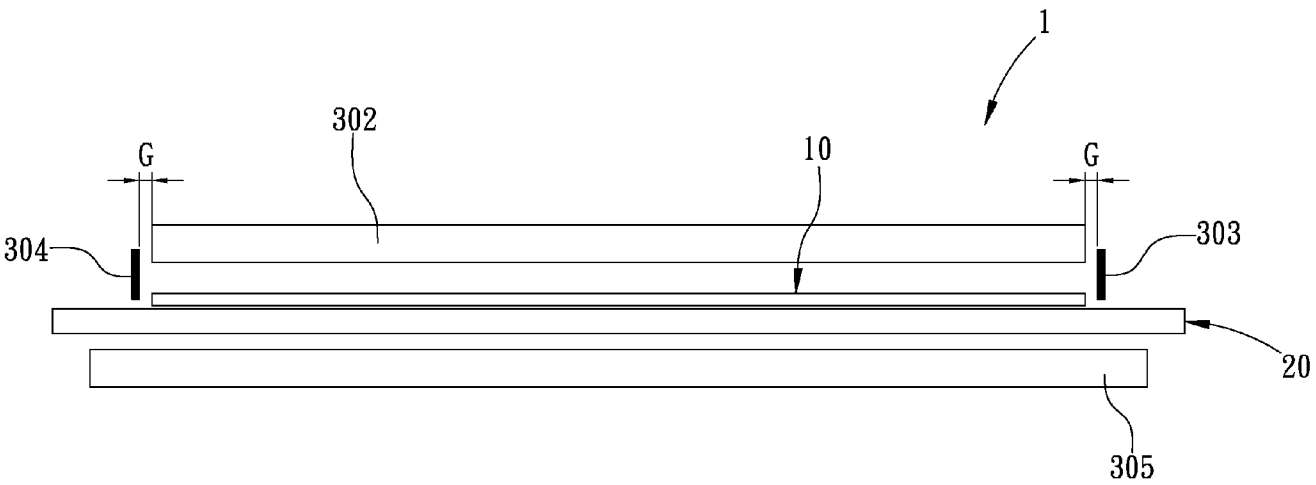
FIG. 4 is another schematic side view of a surface treatment apparatus of the present invention.

Referring to FIG. 1 to FIG. 4, FIG. 1 is a schematic structural view of a surface treatment apparatus of the present invention, FIG. 2 is a schematic view illustrating operation of a surface treatment apparatus of the present invention, FIG. 3 is a schematic side view of a surface treatment apparatus of the present invention, and FIG. 4 is another schematic side view of a surface treatment apparatus of the present invention.

The surface treatment apparatus 1 of the present invention is disposed around a conveying device 20 of a substrate 10, the substrate 10 is placed on the conveying device 20 and conveyed in a predetermined conveying direction A, and the predetermined conveying direction A is parallel to an axial direction of the conveying device 20.

The surface treatment apparatus 1 of the present invention includes a chemical treatment/wiping unit 30, a chemical removing unit 40 and a hot dry unit 50. The chemical treatment/wiping unit 30 includes a first liquid nozzle 301, a second liquid nozzle 302, a first liquid level baffle 303, a second liquid level baffle 304 and a third liquid nozzle 305. The chemical removing unit 40 includes a first gas nozzle 401 and a second gas nozzle 402. The hot dry unit 50 includes at least one third gas nozzle 501 and at least one fourth gas nozzle 502.

The first liquid nozzle 301 is disposed at an adjustable angle above the conveying device 20, and an axial direction B of the first liquid nozzle 301 is perpendicular to the axial direction of the conveying device 20 (parallel to the predetermined conveying direction A).

The second liquid nozzle 302 is disposed at an adjustable angle above the conveying device 20 and spaced apart from the first liquid nozzle 301 by a first predetermined distance D1 in the predetermined conveying direction A, and the axial direction B of the second liquid nozzle 302 is perpendicular to the axial direction of the conveying device 20 (parallel to the predetermined conveying direction A).

The first liquid nozzle 301 and the second liquid nozzle 302 incline at a first angle θ1 facing each other, and the first liquid nozzle 301 and the second liquid nozzle 302 are blade-shaped and used to spray a chemical liquid, such as $Na_2S$, NaF or NaOH.

The first liquid level baffle 303 is disposed on one of sides of the conveying device 20, spaced apart from the conveying device 20 by a gap G, and located within the first predetermined distance D1 spaced apart between the first liquid nozzle 301 and the second liquid nozzle 302.

The second liquid level baffle 304 is disposed on one side of the conveying device 20 away from the first liquid level baffle 303, spaced apart from the conveying device 20 by a gap G, and located within the first predetermined distance D1 spaced apart between the first liquid nozzle 301 and the second liquid nozzle 302.

The third liquid nozzle 305 is disposed below the conveying device 20, and spaced apart from the second liquid nozzle 302 by a second predetermined distance D2 in the predetermined conveying direction A, and the third liquid nozzle 305 inclines at a second angle θ2 facing the conveying device 20 in a direction opposite to the predetermined conveying direction A. The third liquid nozzle 305 is used to spray a cleaning liquid, and since the current experiment shows that a good effect can be achieved by cleaning with pure water, the cleaning liquid may be pure water.

The first gas nozzle 401 is disposed above the conveying device 20, and spaced apart from the third liquid nozzle 305 by a third predetermined distance D3 in the predetermined conveying direction A, the second gas nozzle 402 is disposed below the conveying device 20 and corresponding to the first gas nozzle 401, i.e., the first gas nozzle 401 and the second gas nozzle 402 have the same structure, and are vertically symmetrically placed, and the first gas nozzle 401 and the second gas nozzle 402 incline at a third angle θ3 facing the conveying device 20 in the direction opposite to the predetermined conveying direction A.

The third gas nozzle 501 is spaced apart from the first gas nozzle 401 by a fourth predetermined distance D4 and disposed above the conveying device 20, the fourth gas nozzle 502 is spaced apart from the second gas nozzle 402 by the fourth predetermined distance D4, disposed below the conveying device 20 (i.e., the third gas nozzle 501 and the fourth gas nozzle 502 have the same structure, and are vertically symmetrically placed) and corresponding to the third gas nozzle 501, and the third gas nozzle 501 and the fourth gas nozzle 502 incline at a fourth angle θ4 facing the conveying device 20 in the direction opposite to the predetermined conveying direction A.

The third gas nozzle 501 and the fourth gas nozzle 502 use hot air or hot nitrogen gas below 100° C. for drying.

Furthermore, the third gas nozzle 501 may be a plurality of third gas nozzles (as shown in FIG. 2, the present invention is described by taking two third gas nozzles as an example, but is not limited thereto) spaced apart from one another in the predetermined conveying direction A, the fourth gas nozzle 502 is a plurality of fourth gas nozzles (as shown in FIG. 2, the present invention is described by taking two fourth gas nozzles as an example, but is not limited thereto) spaced apart from one another in the predetermined conveying direction A, and the amount of the third gas nozzles 501 corresponds to the amount of the fourth gas nozzles 502.

In addition, the exit pressures of the first gas nozzle 401, the second gas nozzle 402, the third gas nozzle 501 and the fourth gas nozzle 502 are 3 $kgf/cm^2$, so as to avoid uneven distribution of the undried liquid film.

Therefore, when the substrate 10 enters into the first predetermined distance D1 between the first liquid nozzle 301 and the second liquid nozzle 302, the chemical liquid ejected from the first liquid nozzle 301 and the second liquid nozzle 302 is face to face sprayed on the substrate 10. Because of the intensive spraying of the chemical liquid from the first liquid nozzle 301 and the second liquid nozzle 302, as well as the narrow gap G between the first liquid level baffle 303 and second liquid level baffle 304 and the conveying device 20, most of the chemical liquid remains on the substrate 10, while a small part slowly flows out via the gap G. Thereby, the chemical liquid remains on the surface of the substrate 10 through the face to face spraying by the first liquid nozzle 301 and the second liquid nozzle 302, so that the chemical liquid remaining on the substrate 10 is similar to a liquid cloth wiping the surface of the substrate 10, i.e., the first predetermined distance D1 between the first liquid nozzle 301 and the second liquid nozzle 302 may be adjusted to control the local area of the substrate 10 to be wiped, and the first angle θ1 between the first liquid nozzle 301 and the second liquid nozzle 302 may further be adjusted to control the flow velocity (wiping strength) of the chemical liquid.

After the chemical treatment (wiping) of the surface of the substrate 10 is finished, the substrate 10 is conveyed along with the conveying device 20 to the third liquid nozzle 305, and the residual chemical liquid below the substrate 10 is washed by the cleaning liquid sprayed from the third liquid nozzle 305.

Then, the substrate 10 is continuously conveyed into the chemical removing unit 40 through the conveying device 20, i.e., between the first gas nozzle 401 and the second gas nozzle 402, and the chemical component on the upper and lower surfaces of the substrate 10 is removed by the strength of a weak stream of gas from the first gas nozzle 401 and the second gas nozzle 402 respectively.

Finally, the substrate 10 is continuously conveyed to the hot dry unit 50 through the conveying device 20, i.e., between the third gas nozzle 501 and the fourth gas nozzle 502, and the upper and lower surfaces of the substrate 10 are hot dried by hot air or hot nitrogen gas ejected from the third gas nozzle 501 and the fourth gas nozzle 502.

Taking surface treatment (using/with a Na precursor for absorber layer of CIGS solar PV) on a Mo layer via $Na_2S$ as an example, after chemical treatment, no obvious $Na_2S$ remains on the Mo layer, while $Na_2S$ remains in the crystal gap of the Mo layer columnar crystal surface, but does not form a $Na_2S$ thin film.

Thereby, the chemical liquid is sprayed by the first liquid nozzle 301 and the second liquid nozzle 302, and there is no need to increase the temperature; through the configuration of the first liquid level baffle 303 and the second liquid level baffle 304, the chemical liquid sprayed by the first liquid nozzle 301 and the second liquid nozzle 302 acts on the substrate 10 similar to wiping with a cleaning cloth, which only requires a few seconds to tens of seconds to finish the chemical treatment, and the time of treatment is so short that a good effect is achieved by increasing the concentration of the $Na_2S$ solution to over 1 wt %; moreover, since the third gas nozzle 501 and the fourth gas nozzle 502 use hot air or hot nitrogen gas for hot drying, the temperature of the gas may be controlled below 90° C. based on considerations of safety and drying effects.

The disclosure of the abovementioned embodiments is intended to describe the present invention, but is not intended to limit the present invention, and therefore, modifications of numerical values or replacements of equivalent elements shall still fall within the scope of the present invention.

Through the abovementioned detailed description, it is apparent to those skilled in the art that the present invention surely can achieve the above objectives, and complies with the patent law. Thus, the application for a patent is filed

What is claimed is:

1. A surface treatment apparatus, disposed around a conveying device of a substrate, wherein the substrate is placed on the conveying device and conveyed in a predetermined conveying direction, the surface treatment apparatus comprising:

a first liquid nozzle, disposed above the conveying device at an adjustable angle directed towards the conveying device, wherein the longest dimension of the first liquid nozzle is perpendicular to the predetermined conveying direction and parallel to a plane of the conveying device, said longest dimension of the first liquid nozzle is at least a same width as the substrate, and said first liquid nozzle contains a chemical liquid;

a second liquid nozzle, disposed above the conveying device at an adjustable angle directed towards the conveying device, and spaced apart from the first liquid nozzle by a first predetermined distance in the predetermined conveying direction, wherein the longest dimension of the second liquid nozzle is perpendicular to the predetermined conveying direction and parallel to a plane of the conveying device, the first liquid nozzle and the second liquid nozzle incline at a first angle normal to the plane of the conveying device facing each other, said longest dimension of said second liquid nozzle is at least a same width as the substrate, and said second liquid nozzle contains a chemical liquid;

a third liquid nozzle, disposed below the conveying device, wherein the third liquid nozzle and the second liquid nozzle are spaced apart by a second predetermined distance in the predetermined conveying direction, the third liquid nozzle inclines at a second angle facing the conveying device in a direction opposite to the predetermined conveying direction, said third liquid nozzle has a longest dimension perpendicular to the predetermined conveying direction, and said longest dimension of said third liquid nozzle is wider than said substrate;

a first liquid level baffle, disposed on one of sides of the conveying device, spaced apart from the conveying device by a gap, and located entirely within the first predetermined distance;

a second liquid level baffle, disposed on the opposite side of the conveying device from the first liquid level baffle, spaced apart from the conveying device by the gap, and located entirely within the first predetermined distance;

a first gas nozzle, disposed above the conveying device and spaced apart from the third liquid nozzle by a third predetermined distance in the predetermined conveying direction;

a second gas nozzle, disposed below the conveying device and corresponding to the first gas nozzle, wherein the first gas nozzle and the second gas nozzle are vertically symmetrically placed, and incline at a third angle facing the conveying device in the direction opposite to the predetermined conveying direction; and at least one third gas nozzle, disposed spaced apart from the first gas nozzle by a fourth predetermined distance and disposed above the conveying device; and at least one fourth gas nozzle, disposed spaced apart from the second gas nozzle by the fourth predetermined distance and disposed below the conveying device and corresponding to the third gas nozzle, wherein the third gas nozzle and the fourth gas nozzle incline at a fourth angle facing the conveying device in the direction opposite to the predetermined conveying direction, and the third gas nozzle and the fourth gas nozzle use hot air or hot nitrogen gas below 100° C. for drying, and the exit pressure of the first gas nozzle, the second gas nozzle, the third gas nozzle, and the fourth gas nozzle are 3 $kgf/cm^2$;

wherein, the chemical liquid is $Na_2S$, NaF, or NaOH.

2. The surface treatment apparatus according to claim 1, wherein the first liquid nozzle and the second liquid nozzle are blade-shaped.

3. The surface treatment apparatus according to claim 1, wherein the third liquid nozzle contains pure water.

4. The surface treatment apparatus according to claim 1, wherein the at least one third gas nozzle is a plurality of third gas nozzles spaced apart from one another in the predetermined conveying direction, the at least one fourth gas nozzle is a plurality of fourth gas nozzles spaced apart from one another in the predetermined conveying direction, and the amount of the third gas nozzles corresponds to the amount of the fourth gas nozzles.

* * * * *